United States Patent [19]

Ottoson

[11] Patent Number: 4,790,411

[45] Date of Patent: Dec. 13, 1988

[54] SAWHORSE WORK TABLE

[76] Inventor: James A. Ottoson, Rte. 4, Box 248, Viroqua, Wis. 54665

[21] Appl. No.: 194

[22] Filed: Jan. 2, 1987

[51] Int. Cl.[4] ..... B27B 21/00; B25H 1/06

[52] U.S. Cl. ..... 182/129; 182/153; 182/181; 182/225

[58] Field of Search ..... 182/129, 153, 181–186, 182/224–226, 91, 116

[56] References Cited

U.S. PATENT DOCUMENTS

| | | | |
|---|---|---|---|
| 249,095 | 11/1881 | Reyburn et al. | 182/153 |
| 1,191,687 | 7/1916 | Gillett | 182/153 |
| 1,819,252 | 8/1931 | Linsner | 182/153 |
| 2,343,557 | 3/1944 | Johnson | 182/163 |
| 3,481,430 | 12/1969 | Solomon | 182/153 |
| 3,627,350 | 12/1971 | Cross | 182/91 |
| 4,198,070 | 4/1980 | Weiler | 182/91 |
| 4,403,678 | 9/1983 | Zieg | 182/181 |
| 4,429,765 | 2/1984 | Garcia | 182/153 |
| 4,620,613 | 11/1986 | Albertson | 182/153 |

FOREIGN PATENT DOCUMENTS

| | | | |
|---|---|---|---|
| 372618 | 7/1931 | United Kingdom | 182/153 |

*Primary Examiner*—Reinaldo P. Machado
*Attorney, Agent, or Firm*—Zarley, McKee, Thomte, Voorhees & Sease

[57] ABSTRACT

A sawhorse work table includes a first inverted V-shaped leg support assembly at one end of the table and a second inverted V-shaped leg support assembly at the other end. The work table surface is formed by a pair of horizontally spaced apart horizontally disposed members secured to the outer longitudinal vertical surfaces of the leg members which provides space therebetween sufficient to allow work tools to operate therebetween on work pieces supported on the top support surfaces of the horizontal members. A horizontally disposed shelf is pivotally connected to the table in one position and in a second position extends over the top of the horizontal members to provide a solid top work surface.

4 Claims, 3 Drawing Sheets

SAWHORSE WORK TABLE

BACKGROUND OF THE INVENTION

The typical sawhorse arrangement involves a pair of sawhorses which support the opposite ends of a work piece. A shop tool, such as a saw, is then used on the work piece. This arrangement requires a significant investment in space to accommodate the two sawhorses and money to acquire them. The individual sawhorses do not provide a separate and distinct work surface but normally are only useful when used in connection with a second sawhorse.

It is thus seen that a sawhorse is needed that can function without there being a second sawhorse and support a work piece which can be worked upon by a saw or other hand tool.

SUMMARY OF THE INVENTION

The sawhorse work table of this invention is capable of functioning independently of the second sawhorse and provides a multiple function work surface. Horizontal members are provided on the outside surfaces of the inverted V-shaped legs at each end such that there is a substantial space between the horizontal members whereby the horizontal members function as a support surface and work tools such as a saw may cut work pieces between and for the full length of the horizontal work members.

An auxiliary shelf is provided along the side of the sawhorse on a hinge which is adapted to pivot 180° to a position where the shelf is over the top of the horizontal members and then provides a solid work surface should that be desired. The shelf in its first position is ideally situated for supporting hand tools commonly used during the course of typical work projects.

When a work piece is positioned on the spaced apart horizontal members the work piece is supported on both sides rather than just one side as is the case with typical support surfaces. A piece being drilled can be positioned at any point along the full length of the horizontal members such that the drill bit will extend between the horizontal support members when penetration through the work piece has occurred thereby preventing any damage to the drill bit or the support surface. Clamps can be applied to the work piece and a piece under the horizontal members to lock the work piece solidly on the sawhorse table, if desired.

The legs of the table not only flare laterally outwardly but longitudinally outwardly thereby increasing the stability of the table. The table may also be folded up for storage purposes.

It is thus seen that a multifunction combination sawhorse and work table is provided.

DESCRIPTION OF THE PREFERRED EMBODIMENT

Figure 1:
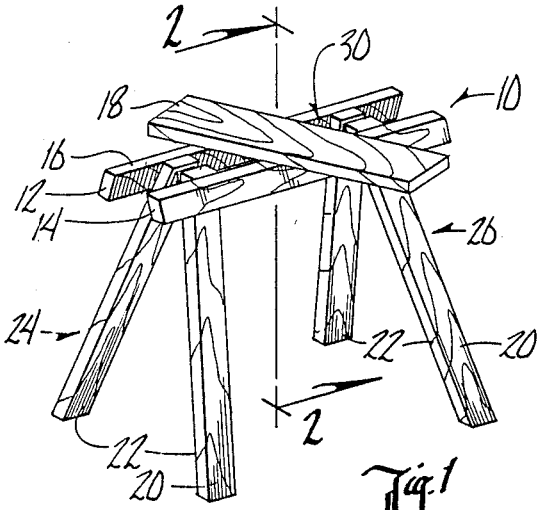
FIG. 1 is a perspective view of the sawhorse work table of this invention supporting a work piece.

The sawhorse work table of this invention is referred to generally in FIG. 1 by the reference numeral 10. The sawhorse work table 10 is seen to include spaced apart horizontally disposed horizontal members 12 and 14 which have a flat top surface 16 on which a work piece 18 is supported. The horizontal members 12 and 14 are secured to the outer face 20 of individual legs 22 of inverted V-shaped leg assemblies 24 and 26 at opposite ends of the sawhorse work table. A hinge 28 pivotally interconnects each of the legs 22 of each of the leg assemblies 24 and 26 and is positioned below the top ends of the legs 22 and the top surfaces 16 of the horizontal members 12 and 14, as seen in FIGS. 2 and 3.

Figure 2:
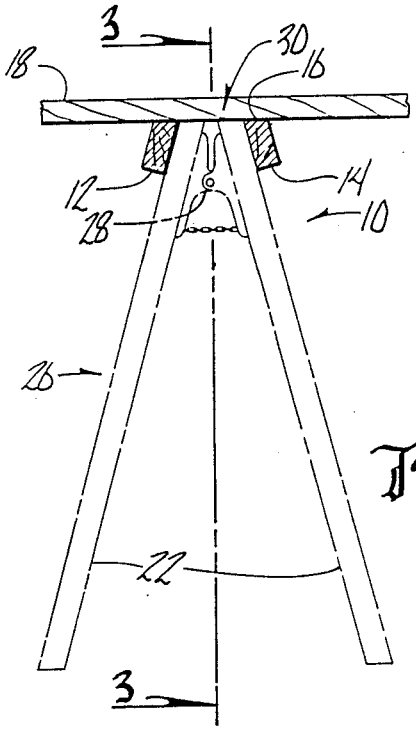
FIG. 2 is a cross-sectional view taken along line 2—2 in FIG. 1.
Figure 3:
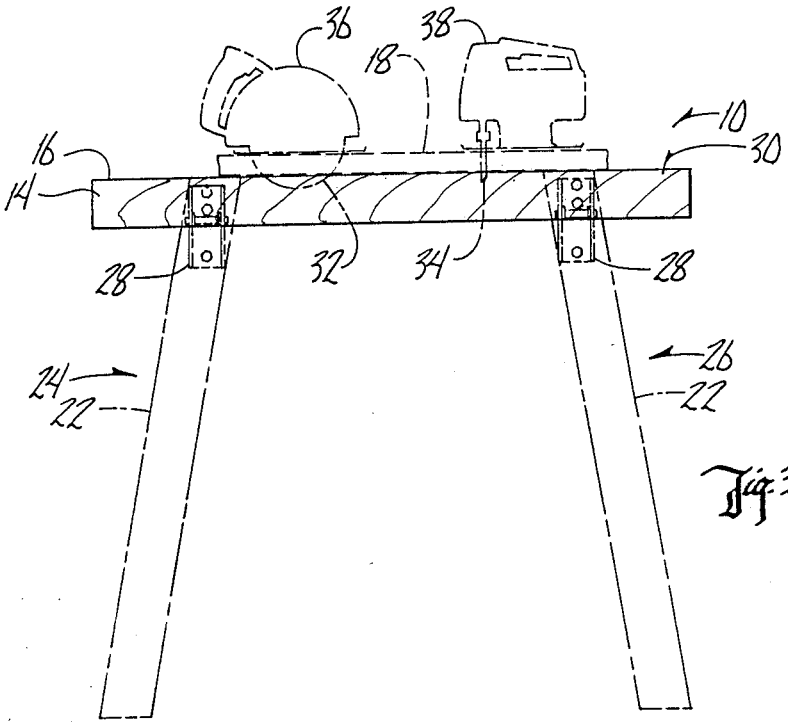
FIG. 3 is a side elevational view thereof showing several tools which may be used on work pieces supported by the table.
Figure 4:
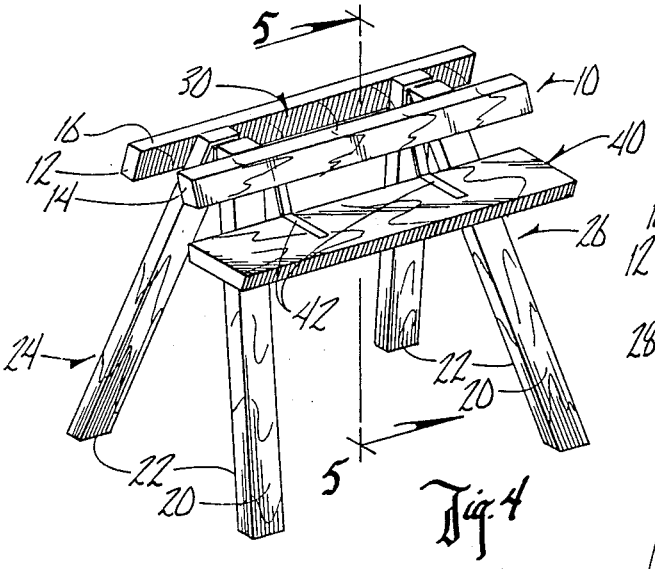
FIG. 4 is a view similar to FIG. 1 but showing additionally a table member positioned on the side of the sawhorse work table.

It is seen that the legs not only flare laterally outwardly but longitudinally outwardly in FIGS. 2 and 3 to provide maximum stability.

The space 30 between the horizontal members 12 and 14 is sufficient for the sawblades 32 and 34 of saws 36 and 38, respectively, to cut the work piece 18. The blades 32 and 34 will extend in the space 30 below the top surface 16 and between the members 12 and 14 along their full length including over the hinges 28. It is seen that the work piece 18 is supported on both of its edges by the horizontal members 12 and 14.

Figure 5:
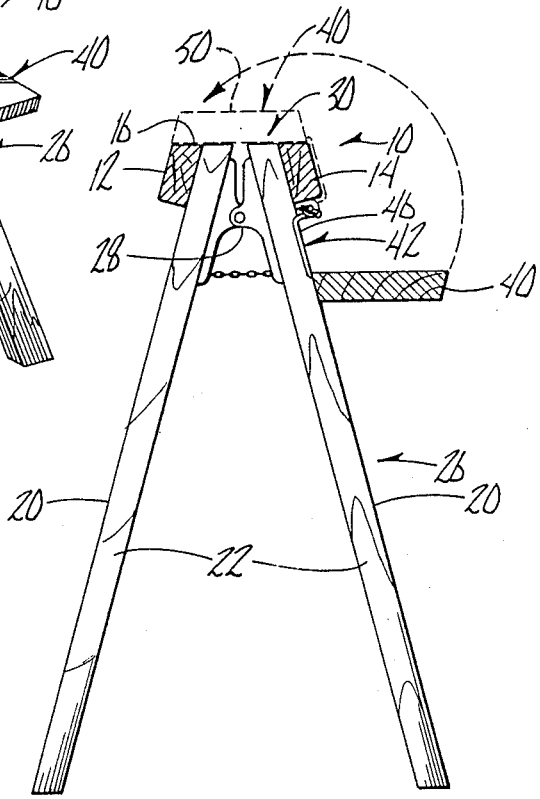
FIG. 5 is a cross-sectional view taken along line 5—5 in FIG. 4 and additionally showing the shelf being adapted to be pivoted to a position over the top of the horizontal members.
Figure 6:
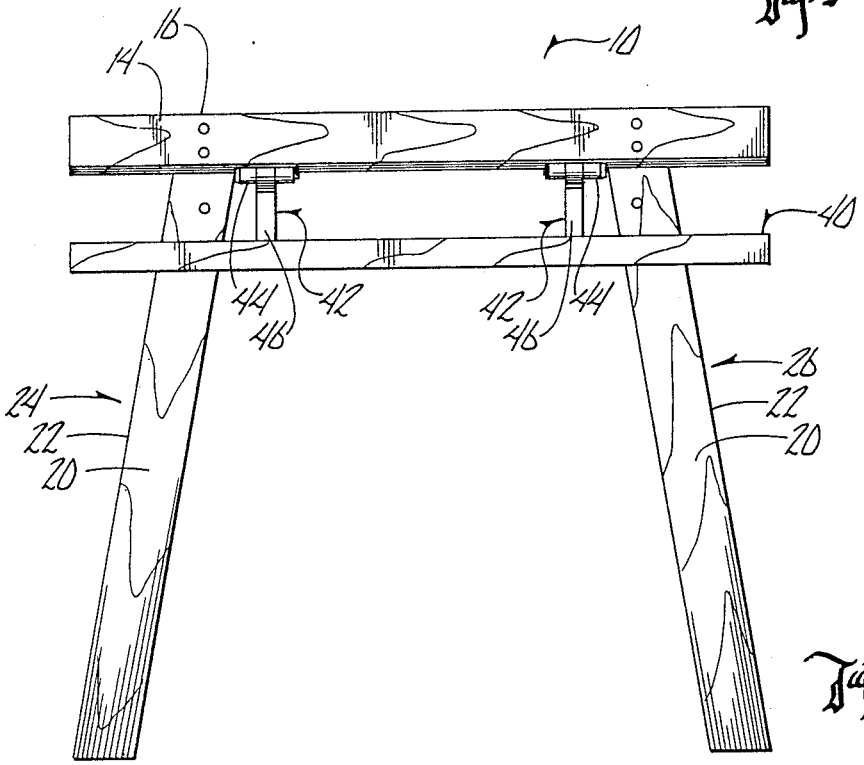
FIG. 6 is a side elevational view thereof.
Figure 7:
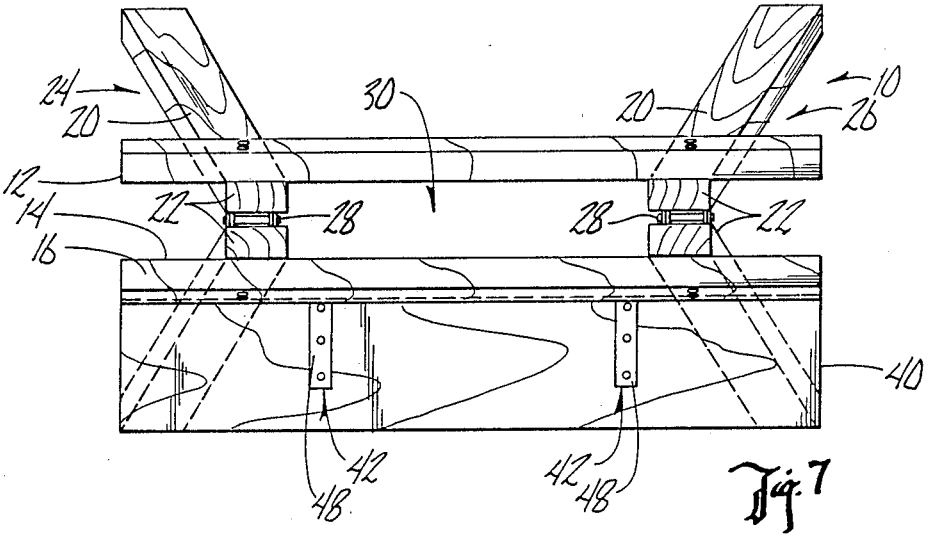
FIG. 7 is a top plan view thereof.
Figure 8:
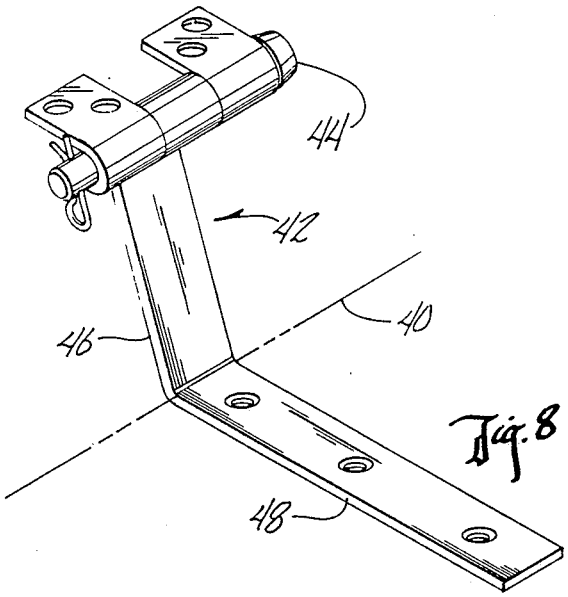
FIG. 8 is a perspective view of the hinge for the shelf.

In FIGS. 4–10 an alternate embodiment of the invention is shown which is similar in all respects to the embodiment shown in FIGS. 1–3 except that it includes additionally a shelf member 40 carried on a pair of brackets 42 connected to a hinge 44, as seen in FIG. 8. The brackets 42 include a downwardly extending leg 46 which merges into a horizontally extending leg 48. To hinge 44 is secured to the bottom edge of the horizontal member 14, as seen in FIG. 6. In FIG. 5 it is seen that the shelf 40 may be pivoted 180° to the dash-line position extending over the tops of the horizontal members 14 and 16 thereby providing a flat horizontal work surface 50. This surface is solid and covers the space 30 between the leg members 14 and 16.

Figure 9:
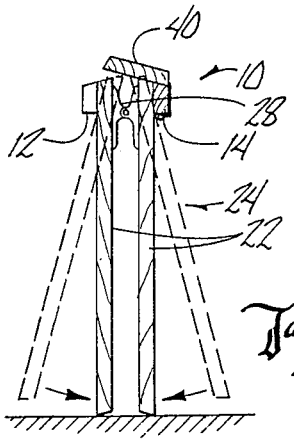
FIG. 9 is a reduced in scale end elevational view showing the sawhorse legs being pivoted between operational and storage positions.
Figure 10:
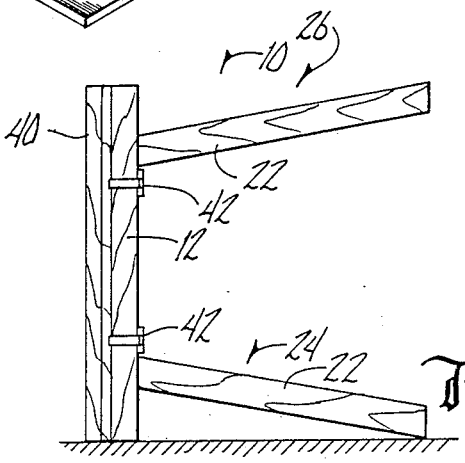
FIG. 10 is a side elevational view of the sawhorse work table in a storage position with the table on end.

Storage of the sawhorse work table can be accomplished in several different fashions as shown in FIGS. 9 and 10. In FIG. 9 the legs 22 are pivoted together to a vertical position and it is seen that the sawhorse will stand without further support and occupies a much smaller space than when it is in its operational position. In FIG. 10 the sawhorse is placed on end in either its collapsed or open condition.

Thus it is seen in operation that the sawhorse may be used for any number of different jobs independently of a second sawhorse as is usually required using conventional sawhorses. The space 30 between the horizontal members 14 and 16 can be utilized by work tools which extend below the top support surfaces 16 of the members 12 and 14. If for some jobs a solid top surface is required the shelf 40 can be pivoted to the cover position of FIG. 5 thereby providing a solid top work surface. The member 40 in its position of FIG. 4 will function as a shelf for work tools. The hinge pin 44 may be removed if it is desired to remove the shelf 40.

What is claimed is:

1. A sawhorse work table comprising, a first inverted V-shaped leg support assembly at one end of said table and a second inverted V-shaped leg support assembly at the other end of said table, each leg assembly includes a pair of leg members having top and bottom ends and inner and outer longitudinal vertical surfaces, a pair of horizontally spaced apart horizontally disposed members secured to the outer surfaces of said leg members to provide spaced apart horizontally disposed coplanar support surfaces whereby the spacing between said horizontal members is sufficient to allow for work tools to operate therebetween on work pieces supported on said support surfaces, and a hinge pivotally interconnects each pair of leg members at their top ends, said hinge being entirely below the top ends of said leg members, and the support surfaces of said horizontal members whereby work tools may operate in the space between said horizontal members over each said hinge throughout the full length of said horizontal members, and said top ends having end surfaces which are coplanar and horizontal, and said coplanar horizontal support surfaces and said end surfaces of said top ends of said leg members being coplanar and horizontal.

2. The structure of claim 1 wherein the leg members of the first of said leg support assemblies are further defined as diverging longitudinally outwardly of the leg members of the second leg support assembly and the leg members of said second leg support assembly diverge longitudinally outwardly of the leg members of the first leg support assembly thereby providing both longitudinal and lateral divergence of said leg members to provide maximum table stability.

3. The structure of claim 1 and hinge means are provided on the table and are connected to a horizontally extended shelf member, said shelf member in a first position has a first horizontal top surface below the top ends of said legs and the support surfaces of said horizontal members and an opposite second horizontal bottom surface, said shelf member being pivotal to a second cover position extending over said horizontal members with said second horizontal bottom surface now being the top surface, and the first horizontal top surface being the bottom surface, and in said cover position, said bottom horizontal surface is coplanar with the horizontal plane of said horizontal support surfaces, and the end surfaces of said top ends of said leg members, and said bottom horizontal surface is in mating, supporting contact with said horizontal support surfaces and the end surfaces of said top ends of said leg members with said top horizontal surface of said shelf in said cover position providing a solid horizontal work surface substantially coextensive with the outer edges of said pair of horizontally spaced apart members.

4. The structure of claim 3 wherein said hinge means includes an L-shaped hinge member having one leg extending downwardly in said first position and upwardly in said second position with said other leg of said L-shaped hinge extending horizontally outwardly of said table in said first position and horizontally inwardly in said second position.

* * * * *